US005311824A

United States Patent [19]

Sauer et al.

[11] Patent Number: 5,311,824

[45] Date of Patent: May 17, 1994

[54] HATCH COVER HINGE AND LOCK ASSEMBLY HAVING SAFETY INTERLOCK FOR HINGE

[75] Inventors: Robert J. Sauer, Blackwood, N.J.; Michael J. Pavlick, Blue Bell, Pa.

[73] Assignee: Transit America Inc., Philadelphia, Pa.

[21] Appl. No.: 20,730

[22] Filed: Feb. 22, 1993

[51] Int. Cl.[5] ..... B61D 39/00

[52] U.S. Cl. ..... 105/377; 49/193; 49/382; 16/231; 16/386; 16/261

[58] Field of Search ..... 105/377; 296/100; 114/201 R, 203; 49/193, 382; 16/231, 356, 386, 261

[56] References Cited

U.S. PATENT DOCUMENTS

| | | | |
|---|---|---|---|
| 479,936 | 8/1892 | Foster | 16/231 |
| 3,685,093 | 8/1972 | Sanders et al. | 16/231 |
| 3,861,083 | 1/1975 | Goiot | 49/193 |
| 4,503,582 | 3/1985 | Gurubatham | 49/193 X |
| 4,613,174 | 9/1986 | Berg et al. | 105/377 X |
| 4,985,962 | 1/1991 | Weber | 16/231 X |

FOREIGN PATENT DOCUMENTS

| | | | |
|---|---|---|---|
| 8502647 | 6/1985 | World Int. Prop. O. | 49/193 |

*Primary Examiner*—Robert J. Oberleitner
*Assistant Examiner*—S. Joseph Morano
*Attorney, Agent, or Firm*—Walter B. Udell

[57] ABSTRACT

A bi-directionally openable hatch cover hinge and lock device for hatch covers which close the hatches on top of railroad cars and which are openable from either side of the car, utilizing a minimum number of component parts and including a passive captive device for the hatch cover to prevent loss of the cover if the latches on one side are left open and the hatch is opened from the other side, and also including an integrated one piece yoke top and handle with a pivoted cam lock attached to the handle, the pivoted cam lock being weight biased toward its locked position and being prevented from rotating beyond its weight biased locking condition by a stop pin.

23 Claims, 4 Drawing Sheets

HATCH COVER HINGE AND LOCK ASSEMBLY HAVING SAFETY INTERLOCK FOR HINGE

This invention relates to hatch cover hinge and lock devices for securing hatch covers on railroad cars such as covered hopper cars. The invention is not however limited to the use on railroad cars but could be utilized on any type hatch requiring securement. More particularly, the invention is specifically directed toward bi-directionally openable hatch covers which close the hatches on top of railroad cars and which are desirably openable from either side of the car.

Railroad hopper cars are typically provided with a longitudinally extending rows of top hatches which it is sometimes desirable to open from one side of the car and sometimes desirable to open from the opposite side of the car for reasons of safety and convenience. Accordingly, it is desirable that the hatch covers be bi-directionally hinged, and devices for accomplishing this purpose have in the past been devised. However, these devices have been complicated and cumbersome involving a relatively large numbers of parts which increases the cost of the device. Moreover, these devices have created a potential safety hazard, in that, in the event that one set of side latches were left unsecured and the hatch were then unlocked from the opposite side, when the hatch was then opened it would fall or be thrown off of the top of the car, creating a serious danger to personnel who might be alongside of the car beneath the hatch. The hatch cover hinge and lock device according to the invention eliminates these problems in a simple and inexpensive manner.

A primary object of the invention is to provide a hatch cover hinge and lock assembly comprising a minimum number of component parts and including a passive captive device for the hatch cover to prevent loss of the cover if the latches on one side are left open and the hatch is opened from the other side.

Another object of the invention is to provide a novel hatch cover hinge and lock assembly as aforesaid which utilizes an integrated one piece yoke top and handle with a pivoted cam lock attached to the handle.

A further object of the invention is to provide a novel hatch cover hinge and lock assembly as aforesaid in which the pivoted car lock is always weight biased toward its locked position, and in Which the operating handle carries a cam stop which prevents the cam lock from rotating beyond its weight biased locking condition.

The foregoing and other objects of the invention will become clear from a reading of the following specification in conjunction with an examination of the appended drawings, wherein.

In the several figures, like parts are denoted by like reference characters.

Figure 1:
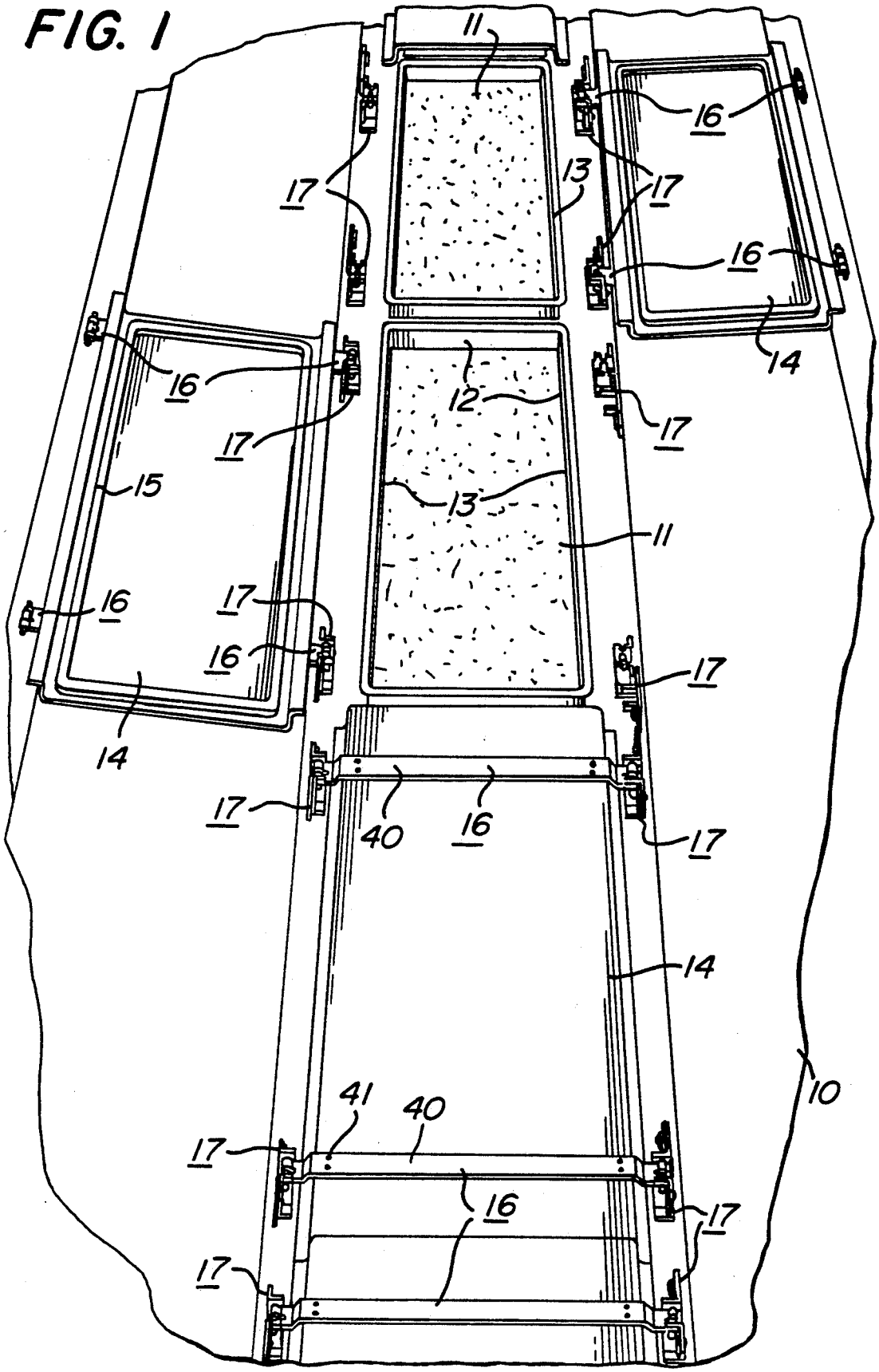
FIG. 1 is a partial top view of a covered railroad hopper car having a centrally longitudinally running plurality of hatches covered by hatch covers, two of Which are shown in the open position open in opposite directions, and also showing hatch covers secured by the hinge and lock assemblies according to the invention.
Figures 2, 3:
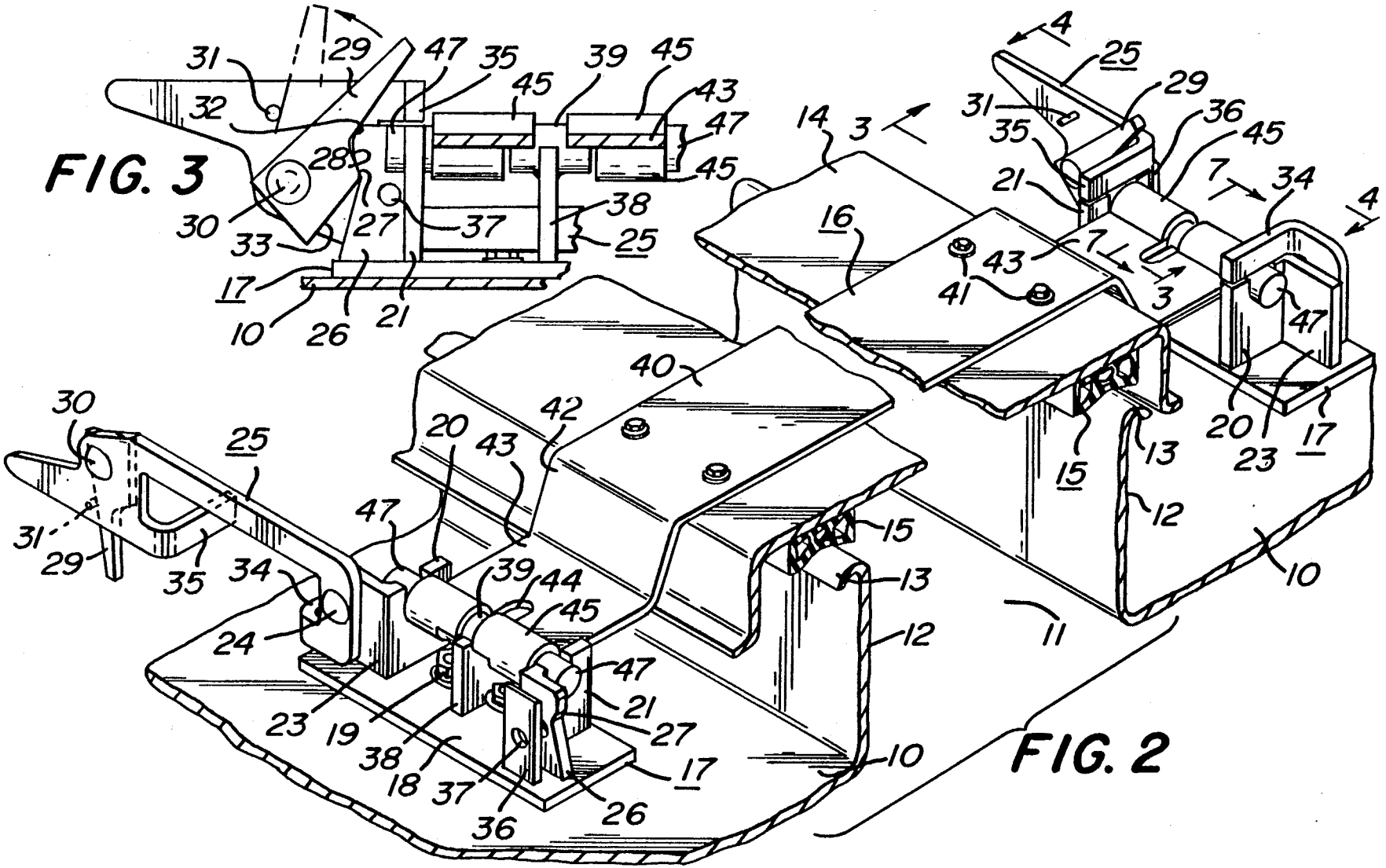
FIG. 2 is a perspective view from above of the hatch cover and hinge lock assemblies according to the invention showing one such assembly in the locked position and another such assembly in the unlocked position.
FIG. 3 is an elevational view of the hinge and lock assembly as would be seen when viewed along the lines 3—3 on FIG. 2.

Referring first to FIGS. 1 and 2, there is seen a hatch covered railroad hopper car having a top generally designated as 10 having a series of centrally extending rectangular hatches 11 defined by upwardly extending hatch sidewalls 12 terminating at their upper edges in rolled over curved hatch rims 13. The hatches 11 are normally closed by rectangular hatch covers 14, the undersides of which are fitted With gaskets 15 Which seat upon the hatch rims 13 and seal the hatches when the hatch covers are in place.

Figure 9:
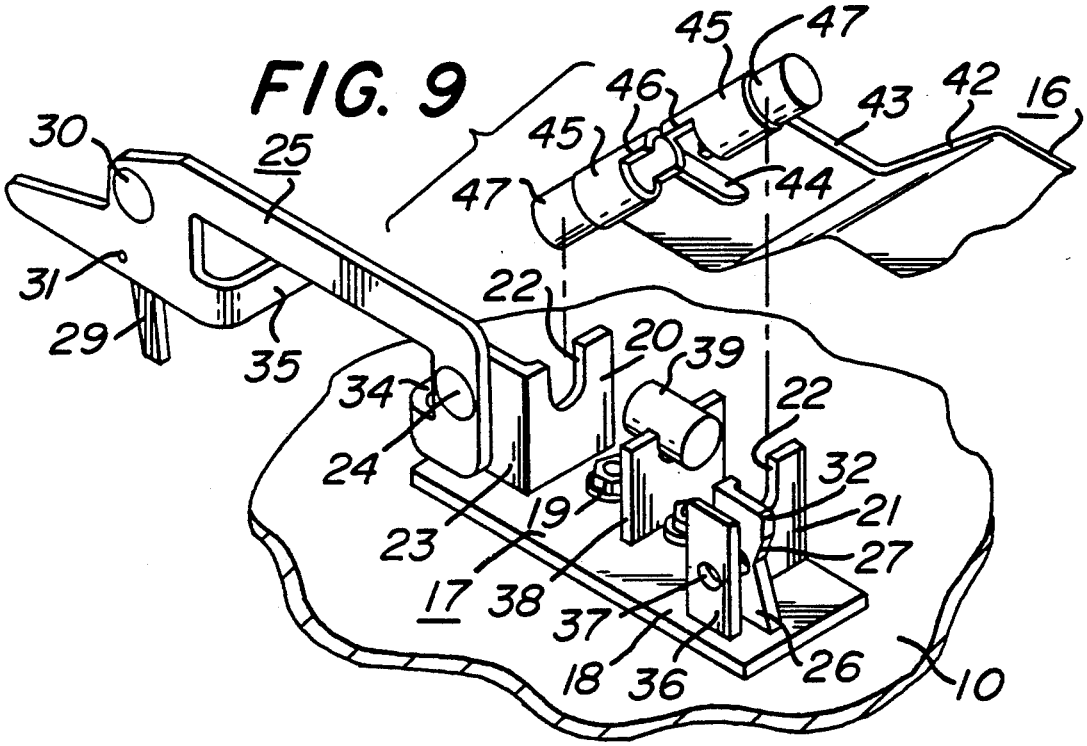
FIG. 9 is a perspective view similar to the fore portion of FIG. 2, but with the part of the hinge and lock assembly which is attached to the hatch cover rotated upward out of engagement with the part of the hinge and lock assembly which is fixed to the car roof to more clearly show the underlying details.

Each of the hatches is fitted with two sets of hinge and lock assemblies, one part of each such assembly being affixed to the hatch cover as a movable sub-assembly and designated generally as 16, with the other part of the hinge and lock assembly being affixed to the hopper car top 10 as a fixed sub-assembly designated generally as 17. Referring now principally to FIGS. 2 and 9 it is seen that the fixed sub-assembly 17 comprises a base plate 18 fixedly secured to the car top 10 by means of nuts and bolts 19, and to which the other parts of the fixed sub-assembly are all secured, as for example by welding. Fixed upon and upstanding from the base plate 18 are spaced apart clevis plates 20 and 21, each having recessed downward from its upper surface a straight sided curved bottom clevis slot 22 the slots being axially aligned in the spaced apart parallel clevis plates 20 and 21.

The clevis plate 20 is formed with a wall 23 perpendicular to the plate 20 to which is pivotally secured by means of the rivet 24 the generally U-shaped locking handle designated as 25. The clevis plate 21 is formed With a cam wall 26 extending perpendicularly to the plane of clevis plate 21 and co-planer with the wall 23 of the clevis plate 20. The cam wall 26 is contoured with an undercut region 27 to latch a matingly contoured surface 28 on the locking cam 29, which latter is pivotally secured to the locking handle 25 by means of the rivet 30. Fixed to the locking handle 25 and extending perpendicularly from the plane of the latter behind the locking cam 29 is a cam stop pin 31 so positioned that it prevents the locking cam 29 from rotating in an unlocking direction beyond the point where the pivoted mass of the locking cam is weight biased into cam locking position. The upper face of the cam wall 26 above the undercut 27 is rounded backward at 32 to engage the surface of the locking cam edge 33 to cam locking surface 28 to automatically move the locking cam 29 around the contour of the cam wall 26 when the locking handle 25 is being moved from its open to its closed position without having to manipulate the locking cam.

The U-shaped locking handle 25 is formed with lock arms 34 and 35 extending orthogonally to the plane of the locking handle, the lock arms 34 and 35 respectively overlying the clevis plates 20 and 21 when the locking handle 25 is in locked position as best seen in FIG. 2. Fixedly secured to and extending upward from the base plate 18 is a stabilizer plate 36 positioned in a plane parallel to the fixed cam wall 26 and spaced therefrom by a distance slightly larger than the thickness of the locking handle 25, to form a slot between the cam wall 26 and stabilizer plate 36 into which the base leg of the U-shaped locking handle moves when the locking handle is moved into locked position. A pair of concentric holes 37 are formed in the fixed cam wall 26 and stabilizer plate 36 at a point above the base leg of the locking handle 25 to accommodate a locking bar which when installed prevents the locking handle 25 from being upwardly rotated into an unlocked position.

Referring now also to the other figures, the portion of the fixed sub-assembly which comprises the safety interlock includes the plate 38 fixed to and upstanding from the base plate 18, the plane of which is positioned parallel to and midway between the clevis plates 20 and 21. Fixedly secured into a semi-circular slot formed downward from the upper edge of the plate 38 is a solid cylinder 39 with its cylindrical axis extending orthogonally to the plates 38, 20 and 21 and passing centrally coaxially through the clevis slots 22.

The parts of the movable sub-assembly 16 which interfit with the fixed sub-assembly are best seen FIGS. 9 and 2, although details are also shown in others of the figures. The movable sub-assembly 16 includes a flat strap 40 extending transversely across the top of and fixedly attached to the hatch covers 14 by means of the bolts 41 or other suitable means. The straps 40 extend beyond the sidewalls of the hatch covers 14 and turn angularly downward, as at 42, for a short distance before again turning horizontally outward, as at 43, substantially parallel to the strap portions 40. The strap end portions 43 are slotted centrally inward from their outer edges as at 44 so that the upper edge of the plate 38 may be accommodated therein when the hinge is in closed position.

Figure 4:
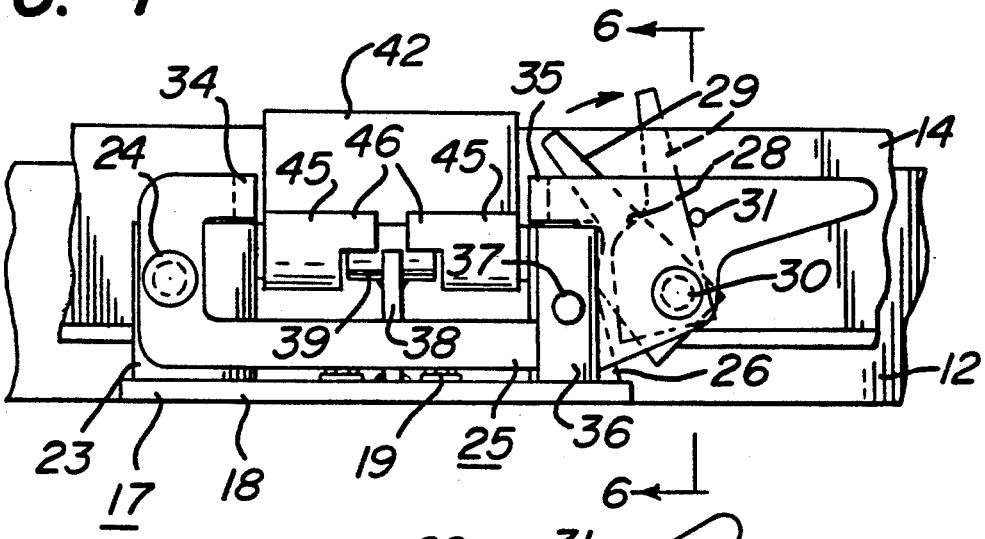
FIG. 4 is an elevational view of the hinge and lock assembly viewed from the opposite side of FIG. 3 as would be seen when viewed along the lines 4—4 on FIG. 2.
Figure 6:
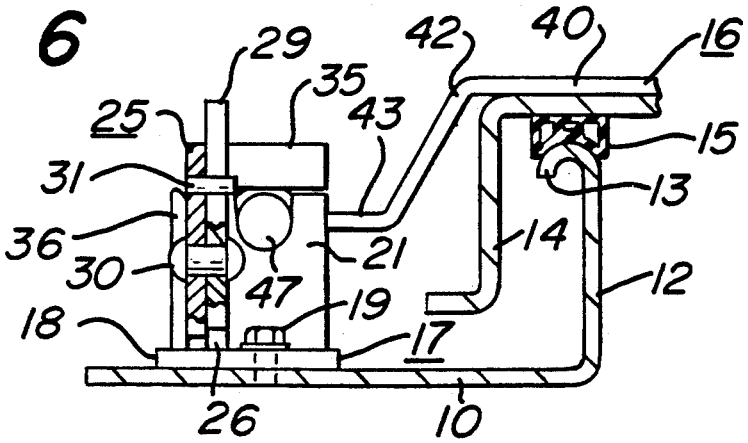
FIG. 6 is a vertical cross sectional view of details of the assembly as would be seen when viewed along the lines 6—6 on FIG. 4.
Figure 7:
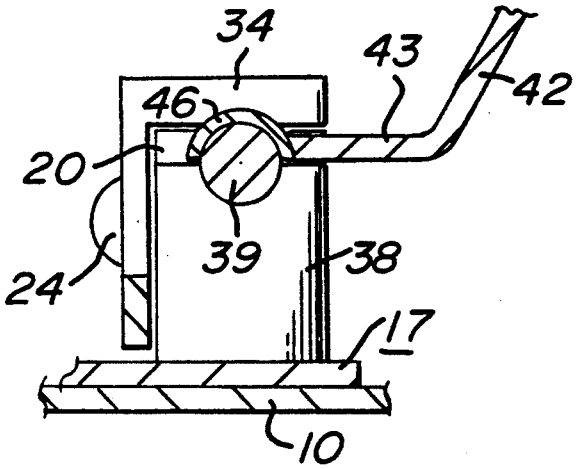
FIG. 7 is a vertical sectional view through the assembly as would be seen when viewed along the lines 7—7 on FIG. 2.

Welded to the outer edge of the strap end portions 43 on both sides of the end slot are hollow cylindrical tubes 45 spaced apart and co-linearly concentric with one another and with the cylinder 39 when the hinge is engaged. As best seen in FIGS. 3, 4 and 9 the facing ends of the tubes 45 have their lower halves cut off axially for a distance sufficient to carry the resections past the ends of the cylinder 39, so that the inside surfaces of the semi-circular portions 46 of the cylinders 45 are seatable downward upon the upper surface of the cylinder 39, as is most clearly shown in FIGS. 3, 4 and 7. Fixedly set into the full cylindrical portions of the tubes 45 and extending coaxially outwardly in opposite directions therefrom are the solid cylinders 47 which are seatable downward to rest in the clevis slots 22 in the clevis plates 20 and 21, as best seen in FIGS. 2, 3, and 6. The cylinders 47 function as trunnions seated in the clevis slots 22, and when held captive in position by the lock arms 34 and 35 of the locking handle 25 constitute the normal rotatable hinge structure about which the entire hatch cover may rotate.

Figure 5:
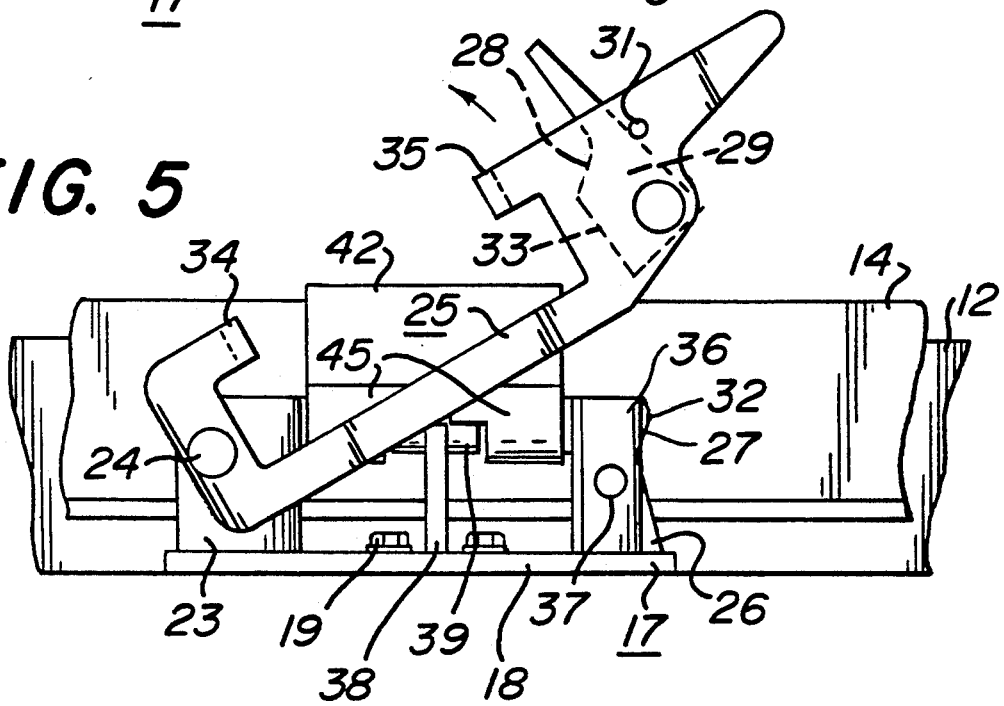
FIG. 5 is a view similar to FIG. 4 excepting that the cam lock has been released and the securing handle is in a partially upwardly rotated position as it is being opened and prior to reaching the fully opened condition as shown in FIG. 2.

This locked hinge condition is illustrated in FIGS. 3, 4, 6 and the upper right hand hinge shown in FIG. 2. As best seen in FIG. 2, with the foreground latch open as shown and the background latch locked as shown, the hatch cover 14 may be pivotally swung upward and backward about the locked background latch while being free to disengage from the foreground latch. FIGS. 3 and 4 show the locked hinge from opposite sides of the structure and illustrate the locking cam 29 in both the locked position and in phantom in the unlocked position. When the locking cam 29 is rotated backward with simple finger pressure, the locking handle 25 is pivotable upward as shown in FIG. 5 to be movable to its completely unlocked position as shown in FIGS. 2 and 9. Reversing the movement of the locking handle 25 automatically, as previously described, rolls the locking cam 29 around the upper camming surface of the fixed cam wall 26 to lock the hinge.

Figure 8:
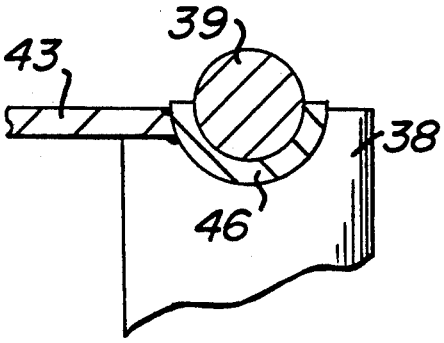
FIG. 8 is a fragmentary view showing engagement of the hatch cover captive device to prevent the open hatch cover from disengaging from the hatch.

The safety interlock is best understood from a viewing of FIG. 2 and FIG. 8 together. Assuming that at some time previously the hatch cover had been unlocked and opened for filling of the hopper car or inspection purposes, and the hatch cover had been returned to its closed position but for some reason there had been failure to rotate the locking handles 25 back into their locked position, then the condition of the hatch cover structure would be as shown in FIG. 2. At some time thereafter when there is again some reason to open the hatch cover, but this time from the other side of the car, namely, from the background hinged side as shown in FIG. 2, if the locking handle 25 is unlocked and the hatch cover thrown open, in the absence of the safety interlock the hatch cover would become totally detached and could fall off of the top of the hopper car with possible serious injury consequences.

However, with the safety interlock as shown and described this is not a possible consequence. When the hatch cover is opened from &he background side and rotated about the unlocked hinge in the foreground of FIG. 2, the semi-circular portions 46 of the cylindrical tubes 45 rotate around and beneath the fixed solid cylinder 39 as shown in FIG. 8 and hold the hatch cover captive to the roof of the hopper car through the cylinder 39 and its connection to the hopper car roof through the plate 38 and the base plate 18, which latter is rigidly secured to the car top 10.

Having now described our invention in connection with a particularly illustrated embodiment thereof, modifications and variations of the invention may now naturally occur from time to time to those normally skilled in the art without departing from the essential scope or spirit of the invention, and accordingly it is intended to claim the same broadly as well as specifically as indicated by the appended claims.

What is claimed is:

1. Hatch cover hinge and lock assemblies for railroad hopper cars in which each car is characterized by having a roof provided with a latch opening which is fitted with a hatch cover, the hinge and lock assemblies providing captive bi-directional hatch opening hinging movement for the hatch cover, and comprising in combination, a) two fixed position sub-assemblies, one of which is fixedly securable to the roof of the car adjacent to one side of the hatch opening and the other of which is fixedly securable to the roof of the car adjacent to the opposite side of the hatch opening, each comprising in combination, 1) hinge pin receiving means having an opening adapted to receive for rotation therewithin a cylindrical surface of at least one hinge pin, 2) lockable and unlockable manually swingable closure means movable between first and second positions for respectively closing and opening the said opening of said hinge pin receiving means, to thereby prevent escape of said at least one hinge pin positioned within said hinge pin opening when said opening is closed by said swingable closure means in its first position, 3) locking means for said swingable closure means for locking said closure means in said first position, said locking means comprising a fixed part and a movable part, one of said fixed and movable parts being affixed to said swingable closure means for movement therewith, and the other of said parts being positionally fixed with respect to said hinge pin receiving means, and 4) an interlock means first part, b) two movable position sub-assemblies respectively fixedly securable to the hatch cover at opposite sides thereof in positions to simultaneously interengage with the said fixed position sub-assemblies, said movable sub-assemblies being movable with said hatch cover, each comprising in combination, 1) said at least one hinge pin being positionable within the said opening of said hinge pin receiving means of one of said fixed position sub-assemblies simultaneously with the positioning of the said at least one hinge pin of the other of the movable position sub-assemblies within the opening of the hinge pin receiving means of the other of the fixed position sub-assemblies, each said hinge pin when so positioned within said opening of said hinge pin receiving means being rotatably securable therewithin by said swingable closure means when the latter is in its said first position closing the opening of said hinge pin receiving means, 2) an interlock means second part, so engagable with the said interlock means first part that when the hatch cover is opened from either side of the hatch, the hatch cover remains secured to the car even if both swingable closure means are in their second position.

2. Hatch cover hinge and lock assemblies as set forth in claim 1 wherein said hinge pin receiving means of each of said fixed position sub-assemblies comprises two coaxially spaced apart such means, and said at least one hinge pin of each of said movable position sub-assemblies comprises two coaxial spaced apart hinge pins, said two hinge pins being respectively simultaneously positionable within said two spaced apart hinge pin receiving means.

3. Hatch cover hinge and lock assemblies as set forth in claim 1 wherein the part of said locking means affixed to said swingable closure means is the said movable part of said locking means.

4. Hatch cover hinge and lock assemblies as set forth in claim 1 wherein the part of said locking means affixed to said swingable closure means is the said movable part of said locking means and comprises a locking cam pivotally secured to said swingable closure means, said locking cam having a locking surface.

5. Hatch cover hinge and lock assemblies as set forth in claim 1 wherein the part of said locking means affixed to said swingable closure means is the said movable part of said locking means and comprises a locking cam pivotally secured to said swingable closure means, said locking cam having a locking surface, and wherein the part of said locking means which is positionally fixed with respect to said hinge pin receiving means is said fixed part and comprises a guiding surface for said locking cam including a cam locking position for said locking cam locking surface when said swingable closure means is moved to its said first position.

6. Hatch cover hinge and lock assemblies as set forth in claim 1 wherein the part of said locking means affixed to said swingable closure means is the said movable part of said locking means and comprises a locking cam pivotally secured to said swingable closure means, said locking cam having a locking surface, and wherein the part of said locking means which is positionally fixed with respect to said hinge pin receiving means is said fixed part and comprises a guiding surface for said locking cam including a cam locking position for said locking cam locking surface, said locking cam being so configured and positioned with respect to its pivotal securement to said swingable closure means and to said fixed part of said locking means that it is gravity biased to automatically engage its locking surface with the guiding surface of said locking means fixed part when said swingable closure means is moved to its said first position, and further including locking cam rotation stop means effective to prevent rotation of said locking cam in an unlocking direction beyond the point which automatically biases the cam toward locking position.

7. Hatch cover hinge and lock assemblies as set forth in claim 1 wherein said swingable closure means comprises a generally planar handle pivotally secured for rotational movement in a substantially vertical plane and having a pair of spaced apart closure arms extending orthogonally from the plane of the handle, said closure arms overlying and closing the openings of said hinge pin receiving means when said handle is rotated into the said first position to thereby capture the hinge pins which are disposed within the openings, and said closure arms being displaced completely away from said hinge pin receiving openings when said handle is rotated into the said second position to thereby unlock the hinge pins.

8. Hatch cover hinge and lock assemblies as set forth in claim 1 wherein said interlock means first part and second part are interengaged but not interlocked when the hatch cover is in place on the car hatch.

9. Hatch cover hinge and lock assemblies as set forth in claim 1 wherein said interlock means first part and second part are interengaged but not interlocked when the hatch cover is in place on the car hatch irrespective of whether said swingable closure means is in its said first or second position.

10. Hatch cover hinge and lock assemblies as set forth in claim 1 wherein said interlock means first part of one of said fixed position sub-assemblies and said interlock means second part of the associated movable position sub-assembly are interengaged and interlocked and function as the hatch cover hinge when the hatch cover is in open position and said swingable closure means is in its said second position.

11. Hatch cover hinge and lock assemblies as set forth in claim 1 wherein said interlock means first part of one of said fixed position sub-assemblies and said interlock means second part of the associated movable position sub-assembly are interengaged and interlocked and function as part of the hatch cover hinge when the hatch cover is in open position and said swingable closure means is in its said first position.

12. Hatch cover hinge and lock assemblies as set forth in claim 1 wherein said hinge pin receiving means of each of said fixed position sub-assemblies comprises two coaxially spaced apart such means, and said at least one hinge pin of each of said movable position sub-assemblies comprises two coaxial spaced apart hinge pins, said two hinge pins being respectively simultaneously positionable within said two spaced apart hinge pin receiving means, and wherein said interlock means first part comprises a fixed position hinge pin located between and coaxial with said spaced apart hinge pin receiving means.

13. Hatch cover hinge and lock assemblies as set forth in claim 1 wherein said hinge pin receiving means of each of said fixed position sub-assemblies comprises two coaxially spaced apart such means, and said at least one hinge pin of each of said movable position sub-assemblies comprises two coaxial spaced apart hinge pins, portions of said two hinge pins being respectively simultaneously positionable within said two spaced apart hinge pin receiving means, and wherein said interlock means first part comprises a fixed position cylindrical hinge pin located between and coaxial with said spaced apart hinge pin receiving means, and wherein said interlock means second part comprises a pair of partial cylindrical sleeves rigidly affixed respectively to and coaxial with said hinge pins and each other, the cylindrical inside surfaces of said sleeves overlyingly engaging the upper portion of the cylindrical surface of said fixed position cylindrical hinge pin when said hatch cover is in its closed position but said sleeves not being interlocked with said fixed position hinge pin, and said partial sleeves rotating around and beneath the under portion of the cylindrical surface of said fixed position cylindrical hinge pin to hold the hatch cover captive when the hatch is opened from the opposite side.

14. Hatch cover hinge and lock assemblies as set forth in claim 1 a) wherein said hinge pin receiving means of each of said fixed position sub-assemblies comprises two coaxially spaced apart such means, and said at least one hinge pin of each of said movable position sub-assemblies comprises two coaxial spaced apart hinge pins, said two hinge pins being respectively simultaneously positionable within said two spaced apart hinge pin receiving means, and b) wherein said swingable closure means comprises a generally planar handle pivotally secured for rotational movement in a substantially vertical plane and having a pair of spaced apart closure arms extending orthogonally from the plane of the handle, said closure arms overlying and closing the openings of said hinge pin receiving means when said handle is rotated into the said first position to thereby capture the hinge pins which are disposed within the openings, and said closure arms being displaced completely away from said hinge pin receiving openings when said handle is rotated into the said second position to thereby unlock the hinge pins.

15. Hatch cover hinge and lock assemblies as set forth in claim 1 a) wherein said hinge pin receiving means of each of said fixed position sub-assemblies comprises two coaxially spaced apart such means, and said at least one hinge pin of each of said movable position sub-assemblies comprises two coaxial spaced apart hinge pins, said two hinge pins being respectively simultaneously positionable within said two spaced apart hinge pin receiving means, b) wherein said swingable closure means comprises a generally planar handle pivotally secured for rotational movement in a substantially vertical plane and having a pair of spaced apart closure arms extending orthogonally from the plane of the handle, said closure arms overlying and closing the openings of said hinge pin receiving means when said handle is rotated into the said first position to thereby capture the hinge pins which are disposed within the openings, and said closure arms being displaced completely away from said hinge pin receiving openings when said handle is rotated into the said second position to thereby unlock the hinge pins, and c) wherein the part of said locking means affixed to said swingable closure means is the said movable part of said locking means and comprises a locking cam pivotally secured to said swingable closure means, said locking cam having a locking surface, and wherein the part of said locking means which is positionally fixed with respect to said hinge pin receiving means is said fixed part and comprises a guiding surface for said locking cam including a cam locking position for said locking cam locking surface when said swingable closure means is moved to its said first position.

16. Hatch cover hinge and lock assemblies as set forth in claim 1 a) wherein said hinge pin receiving means of each of said fixed position sub-assemblies comprises two coaxially spaced apart such means, and said at least one hinge pin of each of said movable position sub-assemblies comprises two coaxial spaced apart hinge pins, said two hinge pins being respectively simultaneously positionable within said two spaced apart hinge pin receiving means, b) wherein said swingable closure means comprises a generally planar handle pivotally secured for rotational movement in a substantially vertical plane and having a pair of spaced apart closure arms extending orthogonally from the plane of the handle, said closure arms overlying and closing the openings of said hinge pin receiving means when said handle is rotated into the said first position to thereby capture the hinge pins which are disposed within the openings, and said closure arms being displaced completely away from said hinge pin receiving openings when said handle is rotated into the said second position to thereby unlock the hinge pins, c) wherein the part of said locking means affixed to said swingable closure means is the said movable part of said locking means and comprises a locking cam pivotally secured to said swingable closure means, said locking cam having a locking surface, d) wherein the part of said locking means which is positionally fixed with respect to said hinge pin receiving means is said fixed part and comprises a guiding surface for said locking cam including a cam locking position for said locking cam locking surface, said locking cam being so configured and positioned with respect to its pivotal securement to said swingable closure means and to said fixed part of said locking means that it is gravity biased to automatically engage its locking surface with the guiding surface of said locking means fixed part when said swingable closure means is moved to its said first position, and e) further including locking cam rotation stop means effective to prevent rotation of said locking cam in an unlocking direction beyond the point which automatically biases the cam toward locking position.

17. Hatch cover hinge and lock assemblies as set forth in claim 1 a) wherein said hinge pin receiving means of each of said fixed position sub-assemblies comprises two coaxially spaced apart such means, and said at least one hinge pin of each of said movable position sub-assemblies comprises two coaxial spaced apart hinge pins, said two hinge pins being respectively simultaneously positionable within said two spaced apart hinge pin receiving means, b) wherein said swingable closure means comprises a generally planar handle pivotally secured for rotational movement in a substantially vertical plane and having a pair of spaced apart closure arms extending orthogonally from the plane of the handle, said closure arms overlying and closing the openings of said hinge pin receiving means when said handle is rotated into the said first position to thereby capture the hinge pins which are disposed within the openings, and said closure arms being displaced completely away from said hinge pin receiving openings when said handle is rotated into the said second position to thereby unlock the hinge pins, and c) wherein said interlock means first part of one of said fixed position sub-assemblies and said interlock means second part of the associated movable position sub-assembly are interengaged and interlocked and function as the hatch cover hinge when the hatch cover is in open position and said swingable closure means is in its said second position.

18. Hatch cover hinge and lock assemblies as set forth in claim 1 a) wherein said hinge pin receiving means of each of said fixed position sub-assemblies comprises two coaxially spaced apart such means, and said at least one hinge pin of each of said movable position sub-assemblies comprises two coaxial spaced apart hinge pins, said two hinge pins being respectively simultaneously positionable within said two spaced apart hinge pin receiving means, b) wherein said swingable closure means comprises a generally planar handle pivotally secured for rotational movement in a substantially vertical plane and having a pair of spaced apart closure arms extending orthogonally from the plane of the handle, said closure arms overlying and closing the openings of said hinge pin receiving means when said handle is rotated into the said first position to thereby capture the hinge pins which are disposed within the openings, and said closure arms being displaced completely away from said hinge pin receiving openings when said handle is rotated into the said second position to thereby unlock the hinge pins, c) wherein said hinge pin receiving means of each of said fixed position sub-assemblies comprises two coaxially spaced apart such means, and said at least one hinge pin of each of said movable position sub-assemblies comprises two coaxial spaced apart hinge pins, portions of said two hinge pins being respectively simultaneously positionable within said two spaced apart hinge pin receiving means, d) wherein said interlock means first part comprises a fixed position cylindrical hinge pin located between and coaxial with said spaced apart hinge pin receiving means, and e) wherein said interlock means second part comprises a pair of partial cylindrical sleeves rigidly affixed respectively to and coaxial with said hinge pins and each other, the cylindrical inside surfaces of said sleeves overlyingly engaging the upper portion of the cylindrical surface of said fixed position cylindrical hinge pin when said hatch cover is in its closed position but said sleeves not being interlocked with said fixed position hinge pin, and said partial sleeves rotating around and beneath the under portion of the cylindrical surface of said fixed position cylindrical hinge pin to hold the hatch cover captive when the hatch is opened from the opposite side.

19. Hatch cover hinge and lock assemblies for railroad hopper cars in which each car is characterized by having a roof provided with a hatch opening which is fitted with a hatch cover, two such hinge and lock assemblies being disposed respectively at opposite sides of the hatch providing captive bi-directional hatch opening hinging movement for the hatch cover, and each such assembly comprising in combination, a) a fixed position sub-assembly fixedly securable to the roof of the car adjacent to one side of the hatch opening, comprising in combination, 1) hinge pin receiving means having an opening adapted to receive for rotation therewithin a cylindrical surface of at least one hinge pin, 2) lockable and unlockable manually swingable closure means movable between first and second positions for respectively closing and opening the said opening of said hinge pin receiving means, to thereby prevent escape of said at least one hinge pin positioned within said hinge pin opening when said opening is closed by said swingable closure means in its first position, 3) locking means for said swingable closure means for locking said closure means in said first position, said locking means comprising a fixed part and a movable part, one of said fixed and movable parts being affixed to said swingable closure means for movement therewith, and the other of said parts being positionally fixed with respect to said hinge pin receiving means, and 4) an interlock means first part, b) a movable position sub-assembly fixedly securable to the hatch cover in position to interengage with the said fixed position sub-assembly, said movable sub-assembly being movable with said hatch cover, comprising in combination, 2) said at least one hinge pin being positionable within the said opening of said hinge pin receiving means of said fixed position sub-assembly, said hinge pin when so positioned within said opening of said hinge pin receiving means as being rotatably securable therewithin by said swingable closure means when the latter is in its said first position closing the opening of said hinge pin receiving means, 2) an interlock means second part, so engageable with the said interlock means first part that when the hatch cover is opened from either side of the hatch, the hatch cover remains secured to the car even if said swingable closure means is in its second position.

20. Hatch cover hinge and lock assemblies as set forth in claim 19 a) wherein said hinge pin receiving means of said fixed position sub-assembly comprises two coaxially spaced apart such means, and said at least one hinge pin of said movable position sub-assembly comprises two coaxial spaced apart hinge pins, said two hinge pins being respectively simultaneously positionable within said two spaced apart hinge pin receiving means, and b) wherein said swingable closure means comprises a generally planar handle pivotally secured for rotational movement in a substantially vertical plane and having a pair of spaced apart closure arms extending orthogonally from the plane of the handle, said closure arms overlying and closing the openings of said hinge pin receiving means when said handle is rotated into the said first position to thereby capture the hinge pins which are disposed within the openings, and said closure arms being displaced completely away from said hinge pin receiving openings when said handle is rotated into the said second position to thereby unlock the hinge pins.

21. Hatch cover hinge and lock assemblies as set forth in claim 19 a) wherein said hinge pin receiving means of said fixed position sub-assembly comprises two coaxially spaced apart such means, and said at least one hinge pin of said movable position sub-assembly comprises two coaxial spaced apart hinge pins, said two hinge pins being respectively simultaneously positionable within said two spaced apart hinge pin receiving means, b) wherein said swingable closure means comprises a generally planar handle pivotally secured for rotational movement in a substantially vertical plane and having a pair of spaced apart closure arms extending orthogonally from the plane of the handle, said closure arms overlying and closing the openings of said hinge pin receiving means when said handle is rotated into the said first position to thereby capture the hinge pins which are disposed within the openings, and said closure arms being displaced completely away from said hinge pin receiving openings when said handle is rotated into the said second position to thereby unlock the hinge pins, c) wherein the part of said locking means affixed to said swingable closure means is the said movable part of said locking means and comprises a locking cam pivotally secured to said swingable closure means, said locking cam having a locking surface, d) wherein the part of said locking means which is positionally fixed with respect to said hinge pin receiving means is said fixed part and comprises a guiding surface for said locking cam including a cam locking position for said locking cam locking surface, said locking cam being so configured and positioned with respect to its pivotal securement to said swingable closure means and to said fixed part of said locking means that it is gravity biased to automatically engage its locking surface with the guiding surface of said locking means fixed part when said swingable closure means is moved to its said first position, and e) further including locking cam rotation stop means effective to prevent rotation of said locking cam in an unlocking direction beyond the point which automatically biases the cam toward locking position.

22. Hatch cover hinge and lock assemblies as set forth in claim 19 a) wherein said hinge pin receiving means of said fixed position sub-assembly comprises two coaxially spaced apart such means, and said at least one hinge pin of said movable position sub-assembly comprises two coaxial spaced apart hinge pins, said two hinge pins being respectively simultaneously positionable within said two spaced apart hinge pin receiving means, b) wherein said swingable closure means comprises a generally planar handle pivotally secured for rotational movement in a substantially vertical plane and having a pair of spaced apart closure arms extending orthogonally from the plane of the handle, said closure arms overlying and closing the openings of said hinge pin receiving means when said handle is rotated into the said first position to thereby capture the hinge pins which are disposed within the openings, and said closure arms being displaced completely away from said hinge pin receiving openings when said handle is rotated into the said second position to thereby unlock the hinge pins, and c) wherein said interlock means first part of said fixed position sub-assembly and said interlock means second part of the movable position sub-assembly are interengaged and interlocked and function as the hatch cover hinge when the hatch cover is in open position and said swingable closure means is in its said second position.

23. Hatch cover hinge and lock assemblies as set forth in claim 19 a) wherein said hinge pin receiving means of said fixed position sub-assembly comprises two coaxially spaced apart such means, and said at least one hinge pin of said movable position sub-assembly comprises two coaxial spaced apart hinge pins, said two hinge pins being respectively simultaneously positionable within said two spaced apart hinge pin receiving means, b) wherein said swingable closure means comprises a generally planar handle pivotally secured for rotational movement in a substantially vertical plane and having a pair of spaced apart closure arms extending orthogonally from the plane of the handle, said closure arms overlying and closing the openings of said hinge pin receiving means when said handle is rotated into the said first position to thereby capture the hinge pins which are disposed within the openings, and said closure arms being displaced completely away from said hinge pin receiving openings when said handle is rotated into the said second position to thereby unlock the hinge pins, c) wherein said hinge pin receiving means of said fixed position sub-assembly comprises two coaxially spaced apart such means, and said at least one hinge pin of said movable position sub-assembly comprises two coaxial spaced apart hinge pins, portions of said two hinge pins being respectively simultaneously positionable within said two spaced apart hinge pin receiving means, d) wherein said interlock means first part comprises a fixed position cylindrical hinge pin located between and coaxially with said spaced apart hinge pin receiving means, and e) wherein said interlock means second part comprises a pair of partial cylindrical sleeves rigidly affixed respectively to and coaxial with said hinge pins and each other, the cylindrical inside surfaces of said sleeves overlyingly engaging the upper portion of the cylindrical surface of said fixed position cylindrical hinge pin when said hatch cover is in its closed position but said sleeves not being interlocked with said fixed position hinge pin, and said partial sleeves rotating around and beneath the under portion of the cylindrical surface of said fixed position cylindrical hinge pin to hold the hatch cover captive when the hatch is opened from the opposite side.

* * * * *